US010722751B2

(12) United States Patent
Liao

(10) Patent No.: US 10,722,751 B2
(45) Date of Patent: Jul. 28, 2020

(54) EXERCISE APPARATUS

(71) Applicant: Hung-Mao Liao, Taichung (TW)

(72) Inventor: Hung-Mao Liao, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 123 days.

(21) Appl. No.: 15/905,838

(22) Filed: Feb. 27, 2018

(65) Prior Publication Data

US 2019/0262666 A1 Aug. 29, 2019

(51) Int. Cl.
*A63B 24/00* (2006.01)
*A63B 22/00* (2006.01)

(52) U.S. Cl.
CPC ..... *A63B 24/0087* (2013.01); *A63B 22/0056* (2013.01); *A63B 24/0062* (2013.01); *A63B 2024/0093* (2013.01); *A63B 2220/51* (2013.01)

(58) Field of Classification Search
CPC ..... A63B 24/0087; A63B 24/0062; A63B 22/0056; A63B 2024/0093; A63B 2220/51
See application file for complete search history.

(56) References Cited

U.S. PATENT DOCUMENTS 4,499,900 A * 2/1985 Petrofsky ..... A61H 1/0214 607/48
5,135,447 A * 8/1992 Robards, Jr. ..... A63B 21/157 482/52
6,902,513 B1 * 6/2005 McClure ..... A63B 24/0006 482/4
9,144,705 B1 * 9/2015 Giannelli ..... A63B 23/0476
2004/0172093 A1 * 9/2004 Rummerfield ..... A61N 1/36003 607/48
2009/0011907 A1 * 1/2009 Radow ..... A63B 24/0084 482/57
2011/0039662 A1 * 2/2011 Gordon ..... A61H 1/0237 482/52
2011/0165995 A1 * 7/2011 Paulus ..... A63B 21/0058 482/5
2011/0195819 A1 * 8/2011 Shaw ..... A63B 24/0062 482/5
2012/0149532 A1 * 6/2012 Giannelli ..... A63B 22/0056 482/52
2012/0190502 A1 * 7/2012 Paulus ..... A63B 21/0058 482/5

(Continued)

*Primary Examiner* — Andrew S Lo

(57) ABSTRACT

A power operated exercise apparatus includes two drive mechanisms configured to drive a left pedal and a right pedal, and a position measuring device, force measuring devices for measuring positions and force conditions of the pedals. A control unit is configured to control the drive mechanism and receive measurement content of the measuring devices, and storing a plurality of exercise programs for being selected by the user. During at least one specific operation period, the control unit repeatedly determines in which directions the left pedal and the right pedal should be moved according to information of positions and force conditions of the pedals so as to meet the displacement path and the correlation of a selected one of the exercise programs and to immediately control the left drive mechanism and the right drive mechanism to respectively drive the left pedal and the right pedal to move in a determined direction.

11 Claims, 8 Drawing Sheets

(56) References Cited

U.S. PATENT DOCUMENTS

2013/0210578 A1* 8/2013 Birrell ..... A63B 71/0622 482/4
2014/0221166 A1* 8/2014 Huang ..... A63B 22/001 482/52
2015/0182784 A1* 7/2015 Barriskill ..... A61N 1/36003 607/3
2015/0202489 A1* 7/2015 Gordon ..... A61H 1/0237 482/53
2015/0224365 A1* 8/2015 Birrell ..... A63B 71/0622 482/4
2015/0246260 A1* 9/2015 Giannelli ..... A63B 23/0476 482/8
2016/0051847 A1* 2/2016 Zhang ..... A63B 22/0605 128/202.13
2016/0129301 A1* 5/2016 Giannelli ..... A63B 21/00069 482/51
2016/0136483 A1* 5/2016 Reich ..... A63B 24/0062 482/2
2016/0184640 A1* 6/2016 Giannelli ..... A63B 22/0605 482/8
2016/0375301 A1* 12/2016 Giannelli ..... A63B 23/0476 482/8
2017/0173381 A1* 6/2017 Giannelli ..... A63B 21/00069
2017/0252604 A1* 9/2017 Gordon ..... A61H 1/0237
2018/0056061 A1* 3/2018 Nishimura ..... A61N 1/3603
2018/0111034 A1* 4/2018 Watterson ..... A63B 71/0622
2018/0117401 A1* 5/2018 Chen ..... A63B 21/0052
2018/0154204 A1* 6/2018 Bayerlein ..... A63B 22/0605
2018/0193692 A1* 7/2018 Giannelli ..... A63B 22/0056
2018/0221708 A1* 8/2018 Gordon ..... A61H 1/0237
2018/0228682 A1* 8/2018 Bayerlein ..... A61H 1/0214
2018/0272181 A1* 9/2018 Giannelli ..... A63B 22/0015
2018/0318647 A1* 11/2018 Foley ..... A63B 22/06
2019/0001184 A1* 1/2019 Schindler-Ivens ..... A63B 22/0017
2019/0001185 A1* 1/2019 Giannelli ..... A63B 22/0605
2019/0046833 A9* 2/2019 Giannelli ..... A63B 22/0015

* cited by examiner

EXERCISE APPARATUS

BACKGROUND

1. Field of the Invention

The present invention relates to an exercise apparatus. More particularly, the present invention relates to an exercise apparatus for performing leg exercises.

2. Description of the Related Art

Basically, leg exercise apparatuses with left and right pedals such as stationary bikes, elliptical exercise machines and steppers are mostly provided for allowing a user to alternately stepping with a specific leg motion so that the pedals could be circulated or reciprocated along a predetermined path. In the prior art, some elliptical exercise machines may change the major axis elevation of the pedal displacement path by adjusting the positions of components, and another exercise machines may extend or shorten the front-rear range of the pedal displacement path according to the user's power for striding, so that the amount of displacement or exercise difficulty of the leg exercise can be changed.

In contrast to general exercise apparatuses which are provided for allowing the user to perform active exercise, a power operated exercise apparatus which is common in medical rehabilitation use allows the user to perform passive exercise. For example, driving the left pedal and the right pedal to move along a circular path at a constant speed by a motor so as to drive the user's legs to perform an action like riding a bike, or driving the left pedal and the right pedal to displace and change angles along predetermined paths by a programmable power mechanism so as to drive the user's legs to perform a standard or adjusted walking movements. When using the above power operated exercise apparatuses, the user's legs do not need to exert a force actively, the user's legs can be completely driven by the power mechanism to force the two legs repeatedly straightened, bent, in order to achieve joint rotation and muscle, ligament flexing. However, there is still a lack of a leg exercise apparatus that allows the user to freely perform various leg exercises and change required motions. Besides, the user performs active exercise rather than passive exercise, that is, both legs have to move and coordinate actively, in order to displace the left pedal and the right pedal in the expected directions.

SUMMARY

The object of the present invention provides a power operated exercise apparatus capable of changing leg movements for allowing the user to freely perform various leg exercises and change required motions. Besides, the user has to perform exercise actively so as to achieve effect of active exercise.

According to one aspect of the present invention, an exercise apparatus comprises a frame, a left pedal, a right pedal, a left drive mechanism, a right drive mechanism, a position measuring device, a left force measuring device, a right force measuring device, an interface device and a control unit. The left pedal is configured to support a left foot of a user, and the right pedal is configured to support a right foot of the user. The left drive mechanism is connected between the frame and the left pedal for being powered to drive the left pedal to move with respect to the frame and changing at least vertical position and horizontal position of the left pedal. The right drive mechanism is connected between the frame and the right pedal for being powered to drive the right pedal to move with respect to the frame and changing at least vertical position and horizontal position of the right pedal. The position measuring device is configured to measure a position of at least one of the left and right pedals with respect to the frame. The left force measuring device is configured to measure a force applied to the left pedal. The right force measuring device is configured to measure a force applied to the right pedal. The interface device is configured for allowing the user to input information. The control unit electrically is connected to the left drive mechanism, the right drive mechanism, the position measuring device, the left force measuring device, the right force measuring device and the interface device for controlling actions of the left drive mechanism and the right drive mechanism, receiving measurement content of the measuring devices, receiving the information input by the user via the interface device. The control unit stores a plurality of exercise programs for being selected by the user, and each of the exercise programs is provided with a displacement path of the left pedal and the right pedal and a correlation between the left pedal and the right pedal on the displacement path.

The exercise apparatus is provided for allowing the user to stand on the left pedal and the right pedal to perform active leg exercises. During at least one specific operation period, the control unit repeatedly determines in which directions the left pedal and the right pedal should be respectively moved according to information of a current position of at least one of the left pedal and the right pedal and current force conditions of the left pedal and the right pedal so as to meet the displacement path and the correlation of a selected one of the exercise programs and to immediately control the left drive mechanism and the right drive mechanism to respectively drive the left pedal and the right pedal to move in a determined direction, and the force condition of either the left pedal or the right pedal affects displacement of both.

Further benefits and advantages of the present invention will become apparent after a careful reading of the detailed description with appropriate reference to the accompanying drawings.

DETAIL DESCRIPTION

Figure 1:
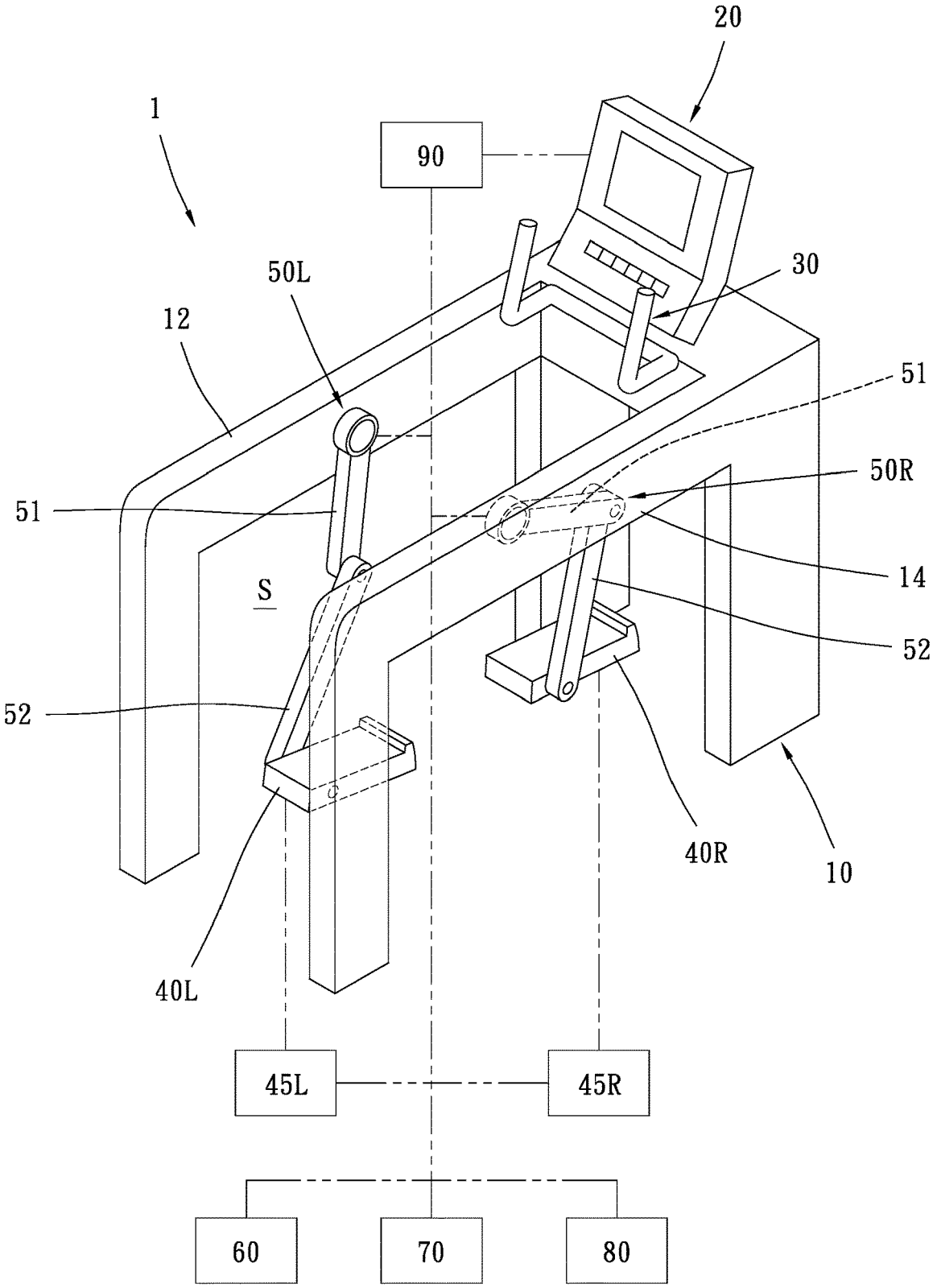
FIG. 1 is a schematic view of a power operated exercise apparatus in accordance with a first embodiment of the present invention.
Figure 2:
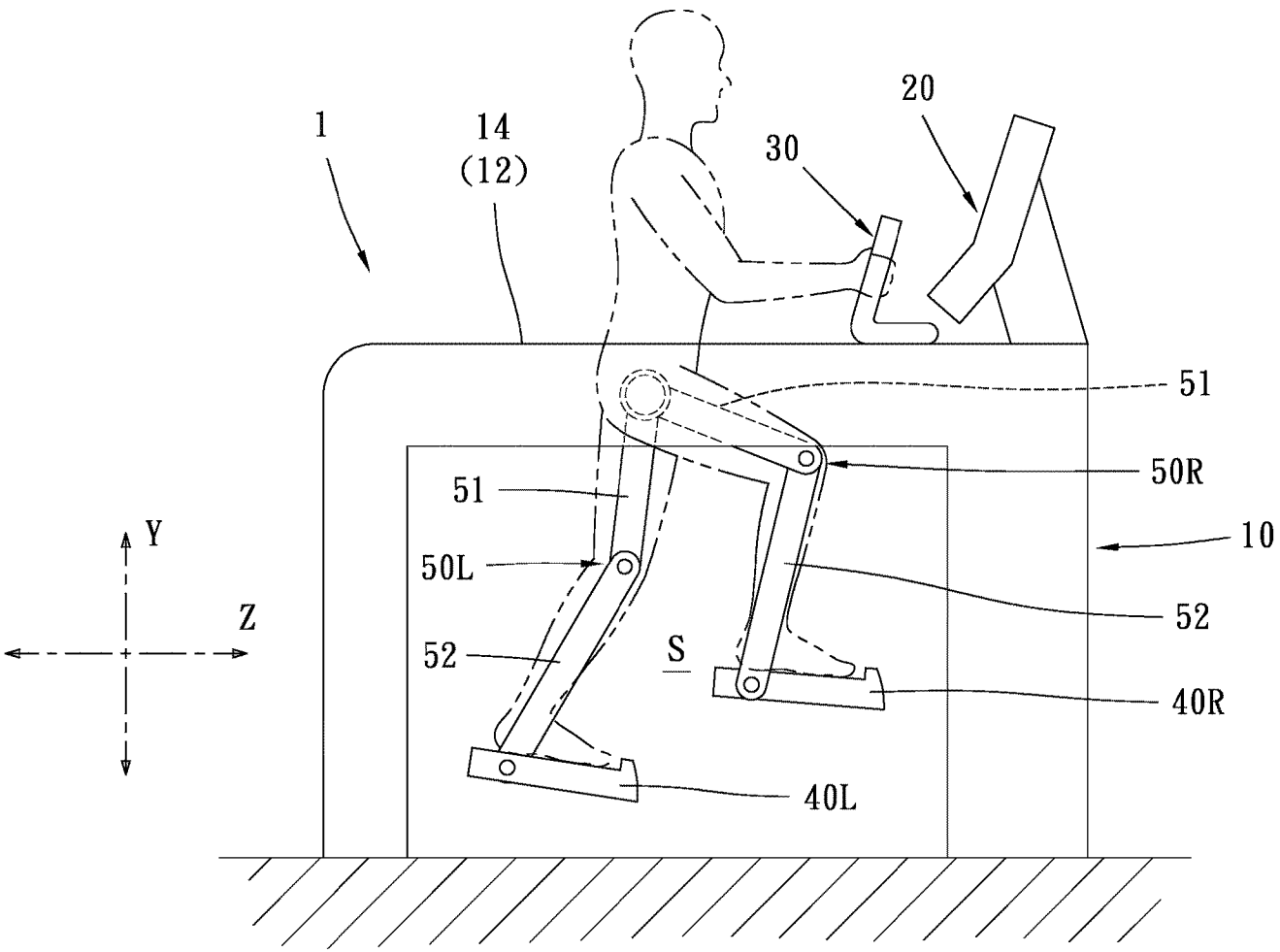
FIG. 2 is a side view of the power operated exercise apparatus for showing the user performing leg exercise.

Referring to FIG. 1 and FIG. 2, a power operated exercise apparatus 1 is illustrated in accordance with a first preferred embodiment of the present invention. The power operated exercise apparatus 1 comprises a frame 10 which is adapted to rest on a ground, a left side part 12 and a right side part 14 opposite to each other, and an exercise space S formed between the left side part 12 and the right side part 14, and a user is able to enter or exit the exercise space S via the rear end of the frame 10. The top of the front end of the frame 10 is provided with an interface device 20 and a handle set 30. The interface device 20, like a console in general exercise apparatuses, can output information to the user and can be used by the user to input information, for example, using an LED array or a liquid crystal display to output usage guideline, exercise status, etc., and allowing the user to input exercise parameters, operational instructions, or the like via buttons or touching the screen. The handle set 30 is provided for allowing the user to grasp. The handle set 30 is fixed on the frame 10 so that the user is able to grasp the handle set 30 to maintain stability of the upper body during leg exercise. In the preferred embodiment of the present invention, the exercise apparatus can also be provided with a movable handle set such that the user is able to perform hand movement while performing leg exercise.

The power operated exercise apparatus 1 has a left pedal 40L for supporting the left foot of the user and a right pedal 40R for supporting the right foot of the user within the exercise space S. A left drive mechanism 50L is connected between the left side part 12 of the frame 10 and the left pedal 40L, and a right drive mechanism 50R is connected between the right side part 14 of the frame 10 and the right pedal 40R. The left drive mechanism 50L and the right drive mechanism 50R can be powered by electrical power, hydraulic pressure, air pressure or the like to respectively drive the left pedal 40L and the right pedal 40R to be displaced relative to the frame 10, including rising and lowering, advancing and retreating, deflecting, etc., and the left pedal 40L and the right pedal 40R could also be positioned at required location and angle if necessary.

In the preferred embodiment of the present invention, the left drive mechanism 50L and the right drive mechanism 50R each has a first deflection arm 51 and a second deflection arm 52. The first deflection arm 51 has a first end (namely the upper end in the figures) pivotally connected to the left side part 12 or the right side part 14 about a first axis (not shown) corresponding to the left-right axial direction and a second end (namely the lower end in the figures). The second deflection arm 52 has a first end (namely the upper end in the figures) pivotally connected to the second end of the first deflection arm 51 about a second axis (not shown) corresponding to the left-right axial direction and a second end (namely the lower end in the figures). The left pedal 40L and the right pedal 40R are pivotally connected to the inner sides of the second ends of the respective second deflection arms 52 about a third axis (not shown), and each of the left pedal 40L and the right pedal 40R has a top surface for the user to step on with one foot. A servomotor (not shown) driven through a servo controller or a servo driver is provided between the respective first deflection arm 51 and the frame 10, between the respective second deflection arm 52 and the corresponding first deflection arm 51, and between the respective pedal 40L/40R and the corresponding second deflection arm 52, so that the respective first deflection arm 51 can be independently driven to deflect about the first axis at a predetermined angular velocity to a predetermined angle, the respective second deflection arm 52 can be independently driven to deflect about the second axis at a predetermined angular velocity to a predetermined angle, and the respective pedal 40L/40R can be independently driven to deflect about the third axis at a predetermined angular velocity to a predetermined angle. By appropriately combining the aforementioned deflecting actions of the first deflection arm 51 and the second deflection arm 52, the left pedal 40L and the right pedal 40R are respectively driven to be displaced in a Y-Z plane at a predetermined velocity in a predetermined direction (note: the aforementioned Y-Z plane refers to a plane defined jointly by Y-axis and Z-axis, where the Y-axis represents the vertical axial direction and the Z-axis represents the front-rear axial direction). Further, by continuously changing the direction and the velocity of the driving displacement, the left pedal 40L and the right pedal 40R can be driven to move uniformly or non-uniformly along an arbitrary path within the movable range of the left pedal 40L and the right pedal 40R. Moreover, by driving the left pedal 40L and the right pedal 40R to deflect relative to the respective second deflection arms 52, the pedals 40L, 40R each can be controlled to a desired angle at a specific position, for example make the top surface of the pedal 40L/40R be horizontal, or make the top surface of the pedal 40L/40R face toward upper front or upper rear at a specific slope. When the three servomotors at the same side stop running, the pedal 40L/40R at the same side will be positioned in the current position and angle.

As shown in FIG. 2, in the preferred embodiment of the present invention, the positions, structures and actions of the left drive mechanism 50L and the right drive mechanism 50R generally correspond to the user's legs, and such mechanism is beneficial for foot movement path and pedal control program design. For example, the movable range and the ideal angular relationship of the first deflection arm 51 (corresponding to the user's thigh), the second deflection arm 52 (corresponding to the user's shank), and the pedal 40L/40R (corresponding to the user's foot) can be set according to ergonomics and kinesiology for setting a reasonable and natural movement range and angular variation of the pedal, and designing a specific pedal displacement path to guide the user to perform the desired leg movement. In operation, since the first deflection arm 51 and the second deflection arm 52 are designed to simulate the shape and the motion of the user's leg, the user is able to perform leg exercise more intuitively for better user experience.

Of course, in addition to the aforementioned structure, the pedal drive mechanism in the present invention may also adopt other structures. For example, as shown in FIG. 2, the first deflection arm is changed to make its front end be pivotally connected to the front end of the frame, the second deflection arm is changed to make its front end be pivotally connected to the rear end of the first deflection arm, and the peal is pivotally connected to the rear end of the second deflection arm, such that the left side part and the right side part can be omitted.

Figure 3:
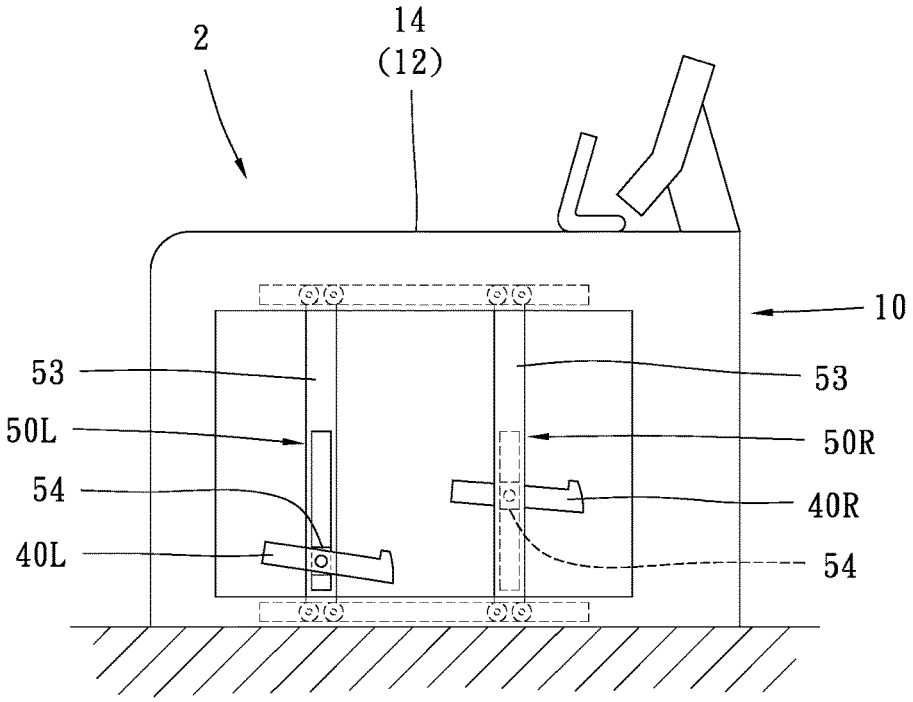
FIG. 3 is a side view of a power operated exercise apparatus in accordance with a second embodiment of the present invention.

Referring to FIG. 3, a power operated exercise apparatus 2 is illustrated in accordance with a second preferred embodiment of the present invention. Both the left drive mechanism 50L and the right drive mechanism 50R have a horizontal displacement seat 53 and a vertical displacement seat 54. The horizontal displacement seat 53 is mounted on the left side part 12 or the right side part 14, which is able to be linearly movable along the front-rear axial direction (Z-axis) such that the horizontal displacement seat 53 can be independently driven to move forward or backward by a predetermined distance at a predetermined velocity. The vertical displacement seat 54 is mounted on the horizontal displacement seat 53, which is able to be linearly movable along the vertical axial direction (Y-axis) such that the vertical displacement seat 54 can be independently driven to move upward or downward by a predetermined distance at a predetermined velocity. The left pedal 40L and the right pedal 40R are respectively mounted on the inner sides of the corresponding vertical displacement seats 54 according to a left-right axis such that each of the two pedal 40L, 40R can be independently driven to deflect about the axis at a predetermined angular velocity to a predetermined angle. By appropriately combining the horizontal movement of the horizontal displacement seat 53 and the vertical movement of the vertical displacement seat 54, the left pedal 40L and the right pedal 40R can be respectively driven to be displaced in a Y-Z plane at a predetermined velocity in a predetermined direction, and even displaced along an arbitrary path. By driving the left and right pedals 40L, 40R to deflect, the pedals 40, 40R each can be controlled to a desired angle at a specific position. As shown in FIG. 3, each drive mechanism has a vertical displacement seat being movable up and down on the frame and a horizontal displacement seat being movable front and back on the vertical displacement seat and the pedals are correspondingly pivoted on the horizontal displacement seat.

Figure 4:
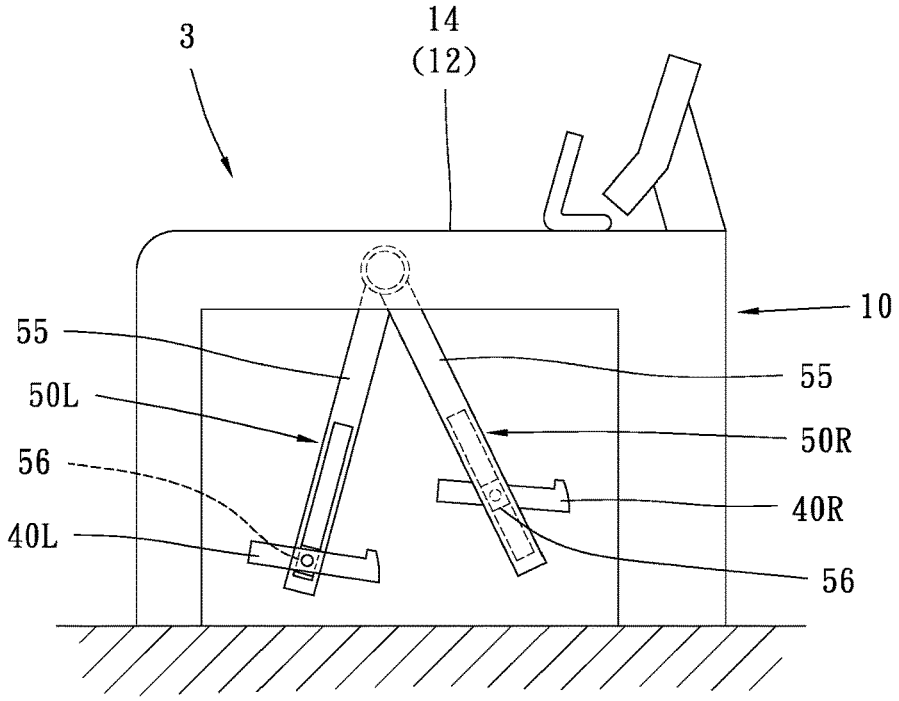
FIG. 4 is a side view of a power operated exercise apparatus in accordance with a third embodiment of the present invention.

Referring to FIG. 4, a power operated exercise apparatus 3 is illustrated in accordance with a third preferred embodiment of the present invention. Both the left drive mechanism 50L and the right drive mechanism 50R have deflection arm 55 and a displacement seat 56. The deflection arm 55 has one end (namely upper end) pivotally mounted on the left side part 12 or the right side part 14 of the frame 10 according to a left-right axis (not shown), so that the deflection arm 55 can be independently driven to deflect about the axis at a predetermined angular velocity to a predetermined angle. The displacement seat 56 is mounted on the deflection arm 55, which is able to be linearly movable along the longitudinal direction of the deflection arm 55, so that the displacement seat 56 can be independently driven to move toward a first end or a second end of the deflection arm 55 by a predetermined distance. The left pedal 40L and the right pedal 40R are respectively mounted on the inner sides of the corresponding displacement seats 56 about a left-right axis, so that each of the two pedals 40L, 40R can be independently driven to deflect about the axis at a predetermined angular velocity to a predetermined angle. By appropriately combining the deflection movement of the deflection arm 55 and the linear displacement of the displacement seat 56, the left pedal 40L and the right pedal 40R can be respectively driven to be displaced in a Y-Z plane at a predetermined velocity in a predetermined direction, and even displaced along an arbitrary path. By driving the left and right pedals 40L, 40R to deflect, the pedals 40, 40R each can be controlled to a desired angle at a specific position.

In the aforementioned embodiments, the drive mechanism 50L/50R can only change the vertical position and the horizontal position of the pedal 40L/40R. In other words, the movable range and the displacement path of each pedal 40L/40R are restricted in a Y-Z plane. If the structures of the aforementioned drive mechanisms 50L, 50R are substantially unchanged but the directions relative to the frame 10 are slightly changed, for example, making the axes of the deflection arms 51, 52, 55 in the first and third embodiments do not correspond to the left-right axial direction (X-axis), or making the displacement path of the horizontal displacement seat 53 and/or the vertical displacement seat 54 have deflections in left and right directions, the left pedal 40L and the right pedal 40R can be displaceable with respect to the frame in the left and right directions, for example, the pedal 40L/40R can be driven to move in rearward right direction or upper left direction namely the displacement path and range are not limited within the Y-Z plane.

Furthermore, the pedal may be driven to be displaced along a predetermined path on a three-dimensional curved surface by using a more complex drive mechanism. For example, the drive mechanism 50L/50R in the FIG. 3 has the horizontal displacement seat 53 movable along the Z-axis (the front-rear axial direction) and the vertical displacement seat 54 movable along the Y-axis (the vertical axial direction), if the drive mechanism 50L/50R is further provided with a transverse seat (not shown) displaceable along a X-axis (left-right axial direction) on each side to form a so-called "Cartesian coordinate robot" in the field of robotic arms. By appropriately combining the up-and-down displacement, back-and-force displacement, and left-and-right displacement, each of the pedals 40L, 40R can be driven to move along an arbitrary path in the three-dimensional space.

On the other hand, in the aforementioned embodiments, the inclined angle of the pedal 40L/40R is changeable only according to an axis corresponding to the left-right axial direction, namely the front end of the pedal is raised or lowered relative to the rear end. Similarly, the present invention may utilize a more complex drive mechanism that enables the pedal to be driven to produce a richer angular variation. For example, driving the pedal 40L/40R to deflect about an axis corresponding to vertical axial direction, so that the pedal 40L/40R can be driven to make its front end deflect inward or outward relative to its rear end, and/or driving the pedal 40L/40R to deflect about an axis corresponding to front-rear axial direction so that its inner side can be raised or lowered relative to its outer side.

In another example, the drive mechanism in the present invention may adopt a so-called 6-axis robot in the field of robotic arms for driving the pedal to be displaced arbitrarily in the three-dimensional space and also drive the pedal to be appropriately deflected according to three mutually perpendicular axes such that the top surface and the major axis of the pedal is able to present any desired angle. The drive mechanism in the present invention is not limited to the use of electrical actuators such as electric motors. For example, the drive mechanism can be power by hydraulic pressure or air pressure system.

Referring to FIG. 1, the power operated exercise apparatus further comprises position measuring devices 60, two angular measuring devices 70 and two displacement measuring devices 80. Such measuring devices 60, 70, 80 are respectively configured for measuring the position, angle and displacement of the left pedal 40L and the right pedal 40R with respect to the frame 10. The measurement contents output by the measuring devices 60, 70, 80 namely the values or signals corresponding to the pedal position, angle and displacement can be used as feedbacks for driving the pedals 40L, 40R to displace (including deflect).

The two position measuring devices 60 can respectively measure the positions of the left pedal 40L and the right pedal 40R relative to the frame 10, including vertical position and horizontal position (or front-rear position). In the first preferred embodiment, each position measuring device 60 may calculate the position of the pedal 40L/40R by measuring the angle of the first deflection arm 51 of the corresponding drive mechanism 50L/50R with respect to the frame 10 and the angle of the second deflection arm 52 relative to the first deflection arm 51. A method for measuring angles of the first deflection arm 51 and the second deflection arm 52 includes applications of conventional techniques such as rotary encoders or resolvers for measuring the rotational direction, number of revolutions and angular position of the rotating shaft of the servomotor so as to determine the current angles of the first deflection arm 51 and the second deflection arm 52. The method can also apply to the power operated exercise apparatuses 2, 3 in the second and third embodiments, that is, measuring the horizontal position of the horizontal displacement seat 53 and the vertical position of the vertical displacement seat 54 shown in FIG. 3, or measuring the angle of the deflection arm 55 or the position of the displacement seat 56 on the deflection arm 55, such that the position of the corresponding pedal 40L/40R can be calculated. Of course, in addition to the above method, there are still many ways to measure or calculate the positions of the pedals 40L, 40R in practice, for example, using infrared sensing, ultrasonic sensing, electromagnetic sensing, light sensing and image sensing to measure the position or angle of the drive mechanism 50L/50R, or directly sensing the vertical position and horizontal position of the pedal 40L/40R.

The two angular measuring devices 70 can respectively measure the angles of the left pedal 40L and the right pedal 40R with respect to the frame 10 (or the ground). In the first preferred embodiment, each angular measuring device 70 may calculate the angle of the pedal 40L/40R such as elevation/depression angle of the pedal 40L/40R by measuring the angle of the first deflection arm 51 of the corresponding drive mechanism 50L/50R relative to the frame 10, the angle of the second deflection arm 52 relative to the first deflection arm 51, and the angle of the pedal 40L/40R relative to the second defection arm 52. Such method can also apply to the power operated exercise apparatuses 2, 3 in the second and third embodiments. Of course, in addition to the above method, there are still many ways to measure or calculate the angles of the pedals 40L, 40R in practice, for example, a conventional gradienter or gyroscope can be directly attached to the pedal 40L/40R.

The two displacement measuring devices 80 can respectively measure the displacement velocities or accelerations of the left pedal 40L and the right pedal 40R relative to the frame 10, including the displacement direction and the speed or speed variation in the displacement direction. Each displacement measuring device 80 may calculate the displacement speed of the pedal 40L/40R by measuring the displacement direction (including rotational direction) and the speed of components of the corresponding drive mechanism 50L/50R. As shown in FIG. 3, the horizontal displacement vector of the horizontal displacement seat 53 and the vertical displacement vector of the vertical displacement seat 54 are directly combined to generate the displacement vectors of the left pedal 40L and the right pedal 40R in the Y-Z plane. The displacement measuring device 80 may continuously measure the position of the pedal by means of a position measurement device (not limited to the aforementioned preferred embodiments), and calculate the average speed of the pedal based on the position difference between two time points separated by a predetermined time (for example, 0.1 second). In the preferred embodiment, the position measuring device 60 and a specific measuring module constitute the displacement measuring device 80. Of course, in addition to the above method, there are still many ways to measure or calculate the displacement speed and the acceleration in practice, for example, a conventional accelerometer or gyroscope can be directly attached to the pedal 40L/40R.

The aforementioned possible embodiments of the position measuring device 60, angular measuring device 70 and displacement measuring device 80 include applications of various sensors, measuring methods, angle or position calculation methods which are conventional techniques in the fields of mechanical automation control, robot arm, motor servo system etc.

In the preferred embodiment of the present invention, the left pedal 40L and the right pedal 40R may have a predetermined position/displacement relationship, so that as long as the position and the displacement speed (or acceleration) of one of the left pedal 40L and the right pedal 40R are known, the current position and the displacement speed (or acceleration) of the other pedal can be calculated. Therefore, the power operated exercise apparatus may have only one position measuring device and one displacement measuring device for directly measuring the position and displacement of one pedal and calculating (indirectly measuring) the position and displacement of the other pedal. Furthermore, the positions and angles of pedals 40L, 40R may have a predetermined relationship, so that as long as the current positions of the left pedal 40L and the right pedal 40R are known, the current angles of the left pedal 40L and the right pedal 40R could be calculated (for example, by table lookup method). Therefore, the power operated exercise apparatus may have no angular measuring device. In other words, the position measuring device 60 and a specific measuring module constitute the angular measuring device 70.

Figure 5C:
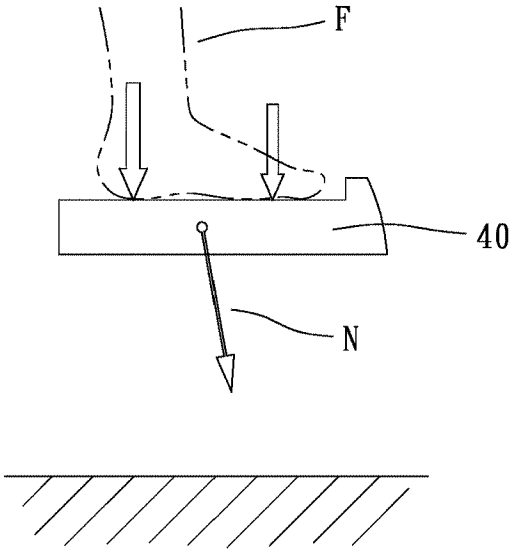
FIGS. 5A to 5C show three conditions for determining the direction of the force applied by the user's foot according to the forces applied on the front half region and the rear half region.
Figure 5B:
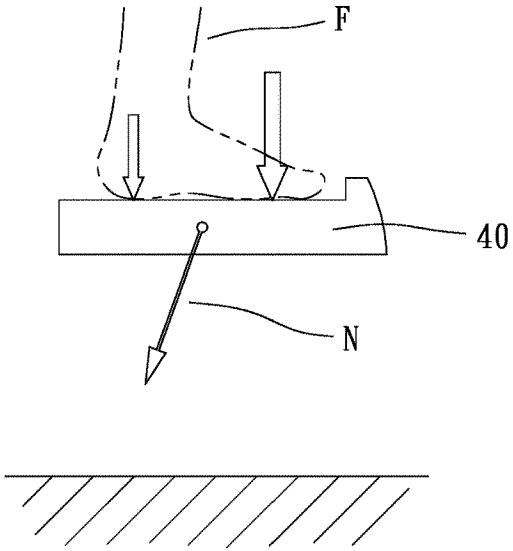
Figure 5A:
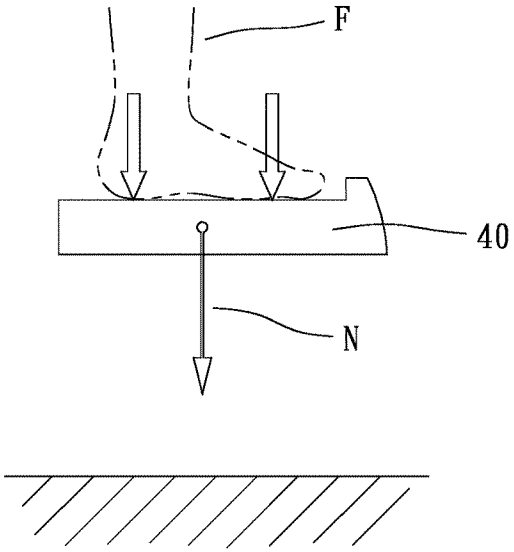

As shown in FIG. 1, the power operated exercise apparatus further comprises a left force measuring device 45L and a right force measuring device 45R respectively measuring force conditions of the left pedal 40L and the right pedal 40R. In brief, the left force measuring device 45L is able to measure the force of the left foot applied to the left pedal 40L, and the right force measuring device 45R is able to measure the force of the right foot applied to the right pedal 40R. In practice, each force measuring device 45L/45R may be a conventional pressure sensor mounted below the top surface of the corresponding pedal 40L/40R for sensing the pressure perpendicular to the top surface of the pedal 40L/40R. Preferably, each of the two pedals 40L, 40R may be provided with a plurality of pressure sensors separated from one another so as to determine the direction and magnitude of the force applied to the pedal according to the distribution of pressures. For example, the front half region and the rear half region of the pedal each is provided with a pressure sensor for respectively sensing the pressure on (the specific part of) the front half region and the rear half region so as to obtain a net force seemed to be applied on the meddle portion of the pedal or a force applied on the whole pedal by a predetermined algorithm. Referring to FIG. 5A to FIG. 5C, take the top surface of the pedal 40 in a horizontal state (note: label 40 indicates both the left pedal 40L and the right pedal 40R). As shown in FIG. 5A, when the forces applied on the front half region (right side in the figure) and the rear half region (left side in the figure) of the pedal 40 are equivalent, it is determined that the middle portion of the pedal 40 receives a downward vertical net force N or the user's foot F exerts a downward vertical net force N on the pedal 40. As shown in FIG. 5B, when the force applied on the front half region of the pedal 40 is greater than the force applied on the rear half region, it is determined that the user's foot F exerts a downward and backward net force N. As shown in FIG. 5C, when the force applied on the rear half region of the pedal 40 is greater than the force applied on the front half region, it is determined that the user's foot F exerts a downward and forward net force N. The specific angle of the net force N relative to the pedal 40 may be determined according to ratio of the force applied on the front half region and the rear half region of the pedal 40. In conjunction with the aforementioned angular determination of the pedal, the angle of the net force N relative to the frame 10 (or the ground) can be calculated. The magnitude of the net force N can be determined according to the sum of forces applied on the front half region and the rear half region of the pedal 40.

Figure 6B:
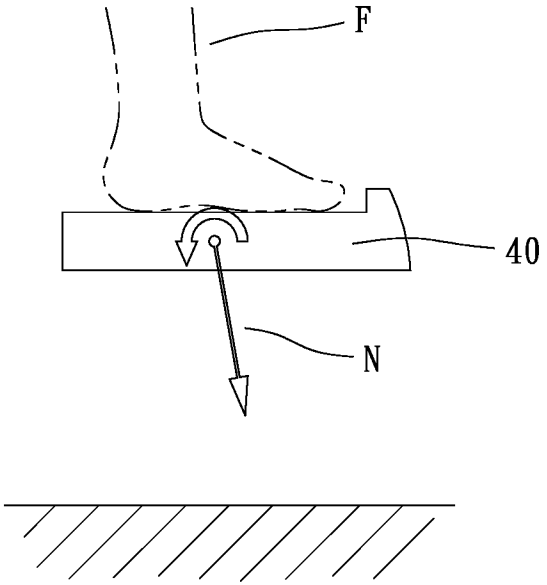
FIG. 6A and FIG. 6B show two conditions for determining the direction of the force applied by the user's foot acceding to the torsional force of the pivot of the pedal.
Figure 6A:
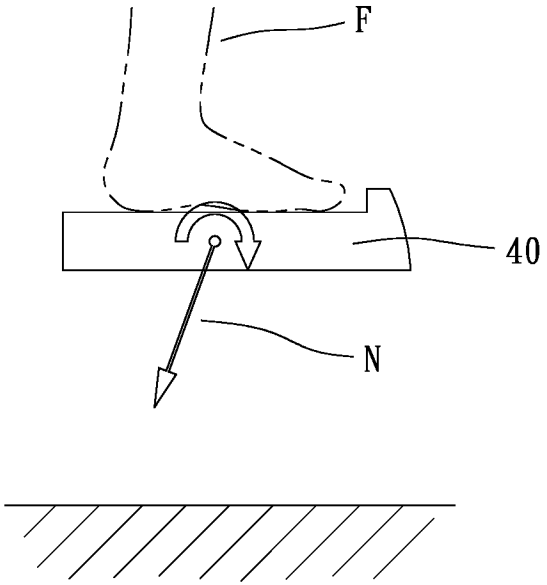

Each of the force measuring devices 45L, 45R may also be provided with a conventional weight sensor (not shown) between the corresponding pedal 40L/40R and the corresponding drive mechanism 50L/50R such as a pivot portion corresponding to the third axis so as to sense the weight supported by the pedal 40L/40R. In addition, the force measuring device 45L/45R may also be provided with a conventional torque sensor (not shown) on the pivot of the pedal 40L/40R such that the direction of the force applied on the pedal can be determined according to the torsional force. Referring to FIG. 6A and FIG. 6B, take the top surface of the pedal 40 in a horizontal state as well. As shown in FIG. 6A, when the pivot of the middle portion of the pedal 40 receives a torsional force corresponding to a clockwise direction as shown in the figure, it represents that the force applied on the front half region of the pedal 40 is greater than the force applied on the rear half region such that the user's foot F is determined to exert a downward and backward net force N on the pedal 40. As shown in FIG. 6B, when the pivot of the middle portion of the pedal 40 receives a torsional force corresponding to a counterclockwise direction as shown in the figure, it represents that the force applied on the rear half region of the pedal 40 is greater than the force applied on the front half region such that the user's foot F is determined to exert a downward and forward net force N on the pedal 40. The specific angle of the net force N relative to the pedal 40 can be determined according to the torsional force and the magnitude of the weight.

As shown in FIG. 1, the power operated exercise apparatus further comprises a control unit 90, which refers to a related hardware, software and firmware assembly that can process electrical signals in a predetermined manner. In practice, it usually takes a built-in specific program microcontroller (MCU) as a processing core. The control unit 90 is electrically connected to the interface device 20 for controlling the output of the interface device 20 and receiving the information input by the user via the interface device 20. The control unit 90 is also electrically connected to the left drive mechanism 50L and the right drive mechanism 50R for controlling the actions of them, and it is substantially equal to control the displacement of the left pedal 40L and the right pedal 40R. The control unit 90 is electrically connected to the position measuring devices 60, the angular measuring devices 70, the displacement measuring devices 80, the left force measuring device 45L and the right force measuring device 45R as well for receiving the measuring content of the above measuring devices 60, 70, 80, 45L, 45R namely the values or signals correspond to the position, angle, displacement, force of the pedal. The foregoing electrical connection may be wired connected or wireless connected through wireless communication technologies such as Bluetooth or radio frequency.

The control unit 90 is equipped with a memory or other computer data storage devices (not shown), in which a plurality of exercise programs are stored. Each exercise program is provided with a displacement path of the left pedal 40L and the right pedal 40R, the angular variations of the left pedal 40L and the right pedal 40R on the aforementioned displacement path, and the correlation between the left pedal 40L and the right pedal 40R on the aforementioned displacement path. The content of the displacement path may be composed of a plurality of pedal positions (for example, the aforementioned Y, Z coordinates) in a sequential relationship, a plurality of consecutive vectors (for example, what direction to move forward in how much distance), or one or more functions (for example, a function corresponding to a circle, ellipse or curve). The content of the angular variations may be a plurality of angles corresponding to the plurality of pedal positions one by one, or may be a plurality of sets of deflection parameters corresponding to the plurality of vectors one by one (for example, according to what axis at what angular velocity and how many degrees of deflection). The above correlation refers to what position the other one should be on the displacement path and/or displaced toward what direction when one of the left pedal 40L and the right pedal 40R is located on what position of the displacement path and/or displaced toward what direction. The aforementioned correlation may be set by method of lookup table or functions.

Figure 7:
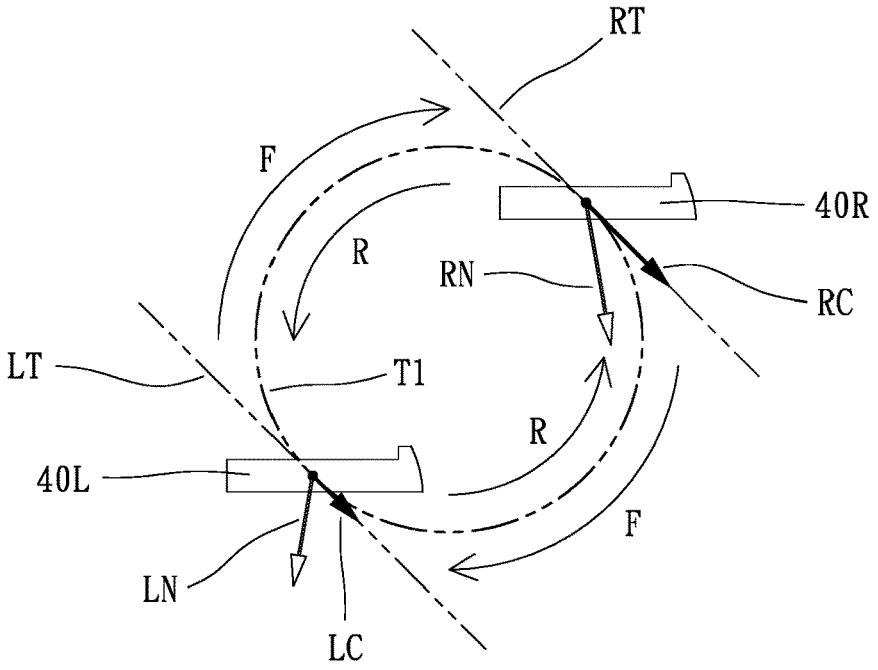
FIG. 7 illustrates a pedal displacement path set by a first exercise program and a correlation between the left pedal and the right pedal.

For example, the plurality of exercise programs stored in the control unit 90 include a first exercise program which sets the displacement paths of the left pedal 40L and the right pedal 40R (hereinafter referred to as first displacement path T1) to be a circular path in the Y-Z plane. As shown in FIG. 7, the first displacement paths T1 of the left pedal 40L and the right pedal 40R overlap in the side view, and the left pedal 40L and the right pedal 40R are kept opposite to each other on the first displacement path in the side view. For example, when one pedal is located at the three o'clock position on the first displacement path T1, the other pedal should be located at the nine o'clock position on the first displacement path T1. For another point of view, the displacement directions of the left pedal 40L and the right pedal 40R may be exactly opposite. For example, when one of the pedals moves along the first displacement path T1 to the lower rear of the space, the other pedal should be displaced along the first displacement path T1 to the upper front of the space. The aforementioned first displacement path T1 defines a positive circulation direction F (namely the clockwise direction in the figure) and a reverse circulation direction R (namely the counterclockwise direction in the figure), and the left pedal 40L and the right pedal 40R are simultaneously displaced according to the positive circulation direction F or the reverse circulation direction R.

Figure 8:
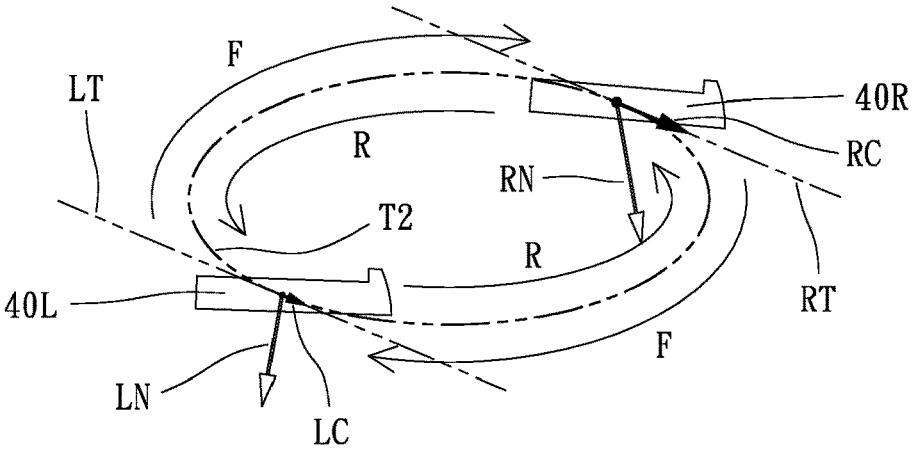
FIG. 8 illustrates a pedal displacement path set by a second exercise program and a correlation between the left pedal and the right pedal.
Figure 9:
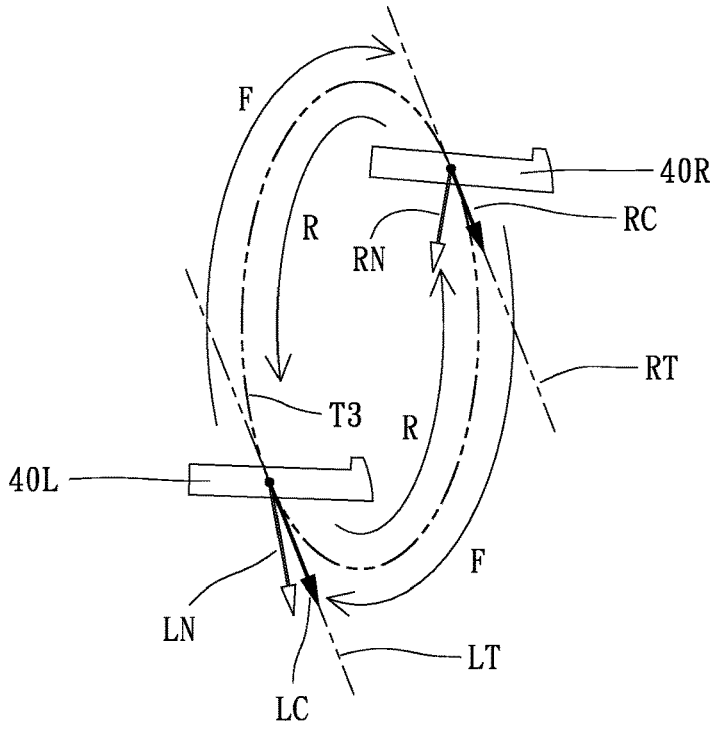
FIG. 9 illustrates a pedal displacement path set by a third exercise program and a correlation between the left pedal and the right pedal.

The exercise programs includes a second exercise program, as illustrated in FIG. 8, which defines a second displacement path T2 as an elliptic path in the Y-Z plane. The elliptic path has a major axis corresponding to the front-rear axial direction, namely the amount of horizontal displacement of the pedal 40L/40R is greater than the amount of vertical displacement during one cycle of the pedal 40L/40R. There is a third exercise program, as illustrated in FIG. 9, which defines a third displacement path T3 as an elliptic path in the Y-Z plane as well but its major axis corresponds to the vertical axial direction namely the amount of vertical displacement is greater than the amount of horizontal displacement. The positions and the displacement directions of the left pedal 40L and the right pedal 40R are also opposite to each other on the displacement path in the second and third exercise programs. The second displacement path T2 and the third displacement path T3 also define a positive circulation direction F and a reverse circulation direction R. The positive circulation direction F is relatively ergonomic in accord with the foot circulation direction of the user during walking or running. In brief, when the pedal 40L/40R cycles along the displacement path T1/T2/T3 in the positive circulation direction F, the pedal 40L/40R is moved forward through the highest point of the path and moved backward through the lowest point of the path.

In practice, in order to provide natural comfort and leg movements with expected effects, the pedal displacement path, angular variations and correlation between the left pedal and the right pedal may be set according to leg movements of actual walking, jogging or running, it may also be set according to pedal movements of conventional elliptical exercise machine or the like. For example, using a conventional motion capture system to capture the leg motion while walking, jogging or running on a treadmill, or using computer software to simulate the operation of the conventional leg exercise apparatuses and capture the information from the pedal motion and then transformed to the content of the aforementioned exercise programs. Instead of circle or ellipse, the displacement path of the pedal may be an arbitrary path, such that the pedal may be driven by a suitable drive mechanism to be displaced along an arbitrary path in a three-dimensional space.

Figure 10:
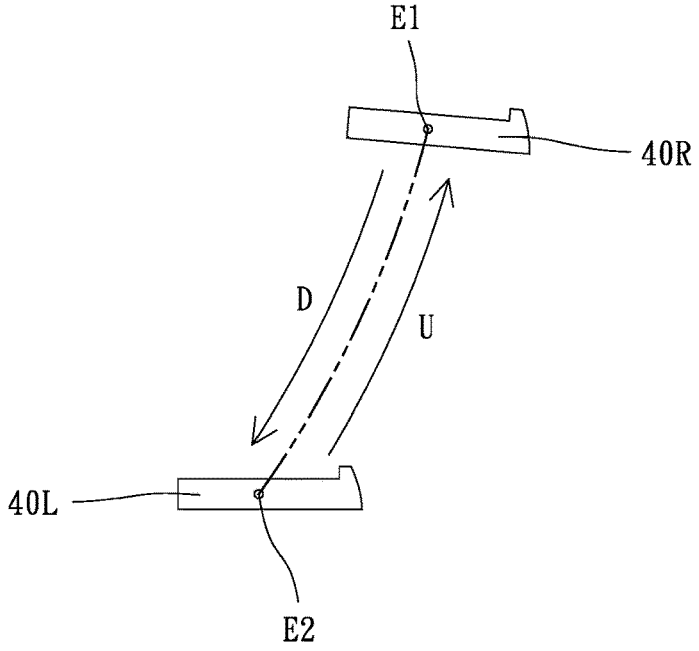
FIG. 10 illustrates a pedal displacement path set by a fourth exercise program and a correlation between the left pedal and the right pedal.

Moreover, the displacement path of the pedal may be a non-closed path with two opposite ends. For example, as shown in FIG. 10, a fourth exercise program defines a fourth displacement path T4 as a curve path with a first end E1 located at upper front of a second end E2. The fourth displacement path T4 defines a descending direction D from the relatively higher first end E1 to the relatively lower second end E2 and a rising direction U from the second end E2 to the first end E1. Furthermore, when one of the two pedals 40L, 40R is located one end of the fourth displacement path T4, the other pedal is located at the other end of the fourth displacement path T4. Additionally, when one pedal is displaced according to the rising direction U, the other pedal should be displaced according to the descending direction D. Such displacement path of the pedal and the correlation between the left pedal and the right pedal are basically provided for simulating the pedal movement of the stepper-type leg exercise apparatus. The aforementioned curve may change to a straight line. In addition, the non-closed path may also be located on a three-dimensional curved surface.

In addition to the aforementioned displacement paths, the present invention may also set a variety of pedal displacement paths such as semi-circular, "∞" shape, trifolium, spiral or other special path shapes, or the shapes of the displacement paths of the left pedal and the right pedal may be different or not overlapped in the side view.

In operation, the power operated exercise apparatus allows the user's two feet to stand on the left pedal 40L and the right pedal 40R, respectively, and grasp the handle set 30 with both hands, so that the user are able to perform corresponding movements of leg lifting, stepping, striding, etc. Instead of non-autonomous passive movement, the power operated exercise apparatus of the present invention is mainly provided for allowing the user to perform exercise like using general leg exercise apparatuses such as an elliptical exercise machine or a stepper, namely the user need to force the legs straight or flexion, and configured to coordinate the control of the power distribution of both feet, the timing of the force, the direction of the force etc. so as to perform a predetermined leg movement and achieve a predetermined exercising effect.

Under normal situations, when the power operated exercise apparatus is empty, the pedals 40L, 40R will be positioned at predetermined positions and at predetermined angles so as to facilitate the user to enter the exercise space S and step forward on the pedals 40L, 40R. For example, one pedal is located close to the ground at a horizontal angle as possible, and the other pedal is located side by side or located in the front at a relatively higher position, that is, when the user ends his/her movement, the control unit 90 controls the left drive mechanism 50L and the right drive mechanism 50R to respectively drive the left pedal 40L and the right pedal 40R to proper positions and proper angles so as to facilitate the user to walk down to the ground and to facilitate the next user to step on the pedals.

In the first operation mode, the user has to select one of the aforementioned exercise programs or select a sequential combination of plural exercise programs through the interface device 20. The interface device 20 may display the content such as shapes of the displacement paths of the exercise programs for the user to view and select. The control unit 90 may have to control the left pedal 40L and the right pedal 40R to suitable positions on the corresponding displacement path before executing the aforementioned exercise programs. When the selected exercise program is executed, the control unit 90 continuously receives the measurement contents of the position measuring device 60, the angular measuring device 70, the displacement measuring device 80, the left force measuring device 45L and the right force measuring device 45R for determining in which direction the left pedal 40L and the right pedal 40R should be respectively displaced in accord with the displacement path and the correlation set by the aforementioned exercise program according to the information of the current position of one of the left pedal 40L and the right pedal 40R, the current force condition of the left pedal 40L and the current force condition of the right pedal 40R repeatedly, and controlling the displacements of the left pedal 40L and the right pedal 40R in the determined direction immediately. Additionally, the force condition of either the left pedal 40L or the right pedal 40R affects displacement of both.

For example, if the pedal displacement path of the exercise program selected by the user is the aforementioned closed path (such as the first, second, third displacement paths T1, T2, T3 shown in FIG. 7, FIG. 8 and FIG. 9), when the force applied to one of the left pedal 40L and the right pedal 40R corresponding to the positive circulation direction F exceeds the force applied to the other pedal corresponding to the reverse circulation direction R by more than a preset positive circulation resistance value, or when the sum of the force applied to the left pedal 40L and the force applied to the right pedal 40R corresponding to the positive circulation direction F exceeds the preset positive circulation resistance value, the control unit 90 controls the left drive mechanism 50L and the right drive mechanism 50R to respectively drive the left pedal 40L and the right pedal 40R to displace in the corresponding positive circulation direction. In contrast, when the force applied to one of the left pedal 40L and the right pedal 40R corresponding to the reverse circulation direction R exceeds the force applied to the other pedal corresponding to the positive circulation direction F by more than a preset reverse circulation resistance value, or when the sum of the force allied to the left pedal 40L and the force applied to the right pedal 40R corresponding to the reverse circulation resistance R exceeds the preset reverse circulation resistance value, the control unit 90 controls the left pedal 40L and the right pedal 40R to displace in the corresponding reverse circulation direction.

Regarding to the force magnitude of the pedal in the aforementioned positive circulation direction or reverse circulation direction, the following algorithm can be used: referring to FIG. 7, for the right pedal 40R, the vector RN represents "the net force the right pedal 40 is currently received", and the tangent RT is a tangent to the current position of the right pedal 40R on the first displacement path T1, representing "the corresponding direction of the right pedal 40R from the current position toward the positive circulation direction or the reverse circulation direction, and the other vector RC is the component of the vector RN (net force) vertically projected on the tangent RT, representing "the component force the right pedal 40R received in the positive circulation direction or the reverse circulation direction"; as for the left pedal 40L, the net force LN, the tangent LT and the component force LC are defined as the right pedal 40R. As shown in FIG. 7, the force (RC) applied to the right pedal 40R in the positive circulation direction F is greater than the force (LC) applied to the left pedal 40L in the reverse circulation direction R, so that the left pedal 40L and the right pedal 40R are displaced together along the first displacement path T1 according to the positive circulation direction F. Similarly, the left pedal 40L and the right pedal 40R shown in FIG. 8 are displaced together along the second displacement path T2 according to the positive circulation direction F; and the left pedal 40L and the right pedal 40R shown in FIG. 9 are displaced together along the third displacement path T3 according to the reverse circulation direction R.

In the case of the closed path, when the more the force applied to one of the left pedal 40L and the right pedal 40R corresponding to the positive circulation direction F exceeds the force applied to the other pedal corresponding to the reverse circulation direction R by more than the preset positive circulation resistance value, or the more the sum of the force applied to the left pedal 40L and the force applied to the right pedal 40R corresponding to the positive circulation direction F exceeds the preset positive circulation resistance value, the faster the speed of displacement of the left pedal 40L and the right pedal 40R driven by the left drive mechanism 50L and the right drive mechanism 50R. Similarly, when the more the force applied to one of the left pedal 40L and the right pedal 40R corresponding to the reverse circulation direction R exceeds the force applied to the other pedal corresponding to the positive circulation direction F by more than the preset reverse circulation resistance value, or the more the sum of the force applied to the left pedal 40L and the force applied to the right pedal 40R corresponding to the reverse circulation direction R exceeds the preset reverse circulation resistance value, the faster the speed of displacement of the left pedal 40L and the right pedal 40R driven by the left drive mechanism 50L and the right drive mechanism 50R.

The interface device 20 has a setting interface (not shown) for allowing the user to set the aforementioned positive circulation resistance value and the reverse circulation resistance value. Basically, if the aforementioned resistance value is set higher, the user must exert a greater force on the pedal (or the force difference between the left and right feet) to drive the pedal to be displaced in the expected direction at the expected speed.

If the pedal displacement path of the exercise program selected by the user is the aforementioned non-closed path (such as the fourth displacement paths T4 shown in FIG. 10), when the force applied to the left pedal 40L corresponding to the descending direction D exceeds the force applied to the right pedal 40R corresponding to the descending direction D by more than a preset resistance value, the control unit 90 controls the left pedal 40L to displace in the corresponding descending direction D and controls the right pedal 40R to displace in the rising direction U simultaneously. In contrast, when the force applied to the right pedal 40R corresponding to the descending direction D exceeds the force applied to the left pedal 40L corresponding to the descending direction D by more than the preset resistance value, the control unit 90 controls the right pedal 40R to displace in the corresponding descending direction D and controls the left pedal 40L to displace in the rising direction U simultaneously.

In the condition of the non-closed path, the more the force applied to one of the left pedal 40L and the right pedal 40R in the descending direction D exceeds the force applied to the other pedal in the descending direction D, the faster the speed of displacement of the left pedal 40L and the right pedal 40R. The resistance value can also be set via the aforementioned interface device 20. Similarly, the higher the resistance value, the harder it is to pedal.

In another operation mode, the control unit 90 automatically select a suitable exercise program according to the information of the current position of one of the left pedal 40L and the right pedal 40R, the current force condition of the left pedal 40L and the current force condition of the right pedal 40R repeatedly for determining in which direction the left pedal 40L and the right pedal 40R should be respectively displaced so as to meet the displacement path and the correlation set by the selected exercise program and the left pedal 40L and the right pedal 40R are immediately controlled to be displaced in the determined direction.

Figure 11A:
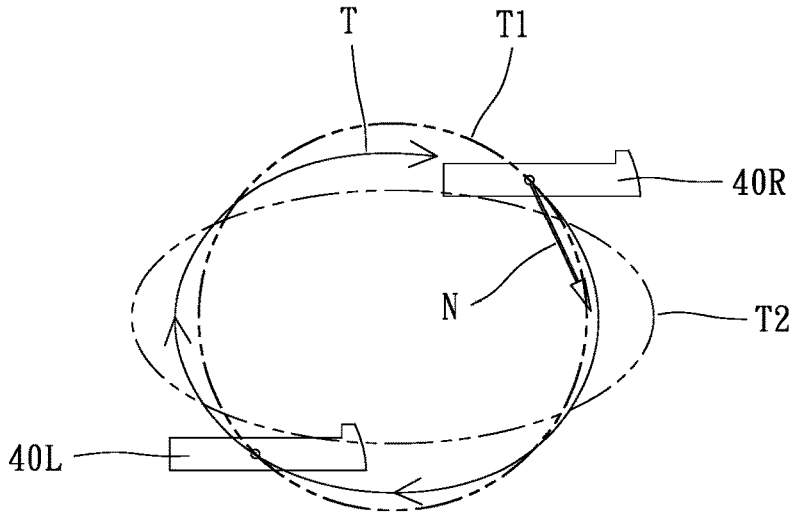
FIG. 11A and FIG. 11B illustrate two conditions in which the displacement path changed from one displacement path to another displacement path is determined according to the force condition of the pedal.
Figure 11B:
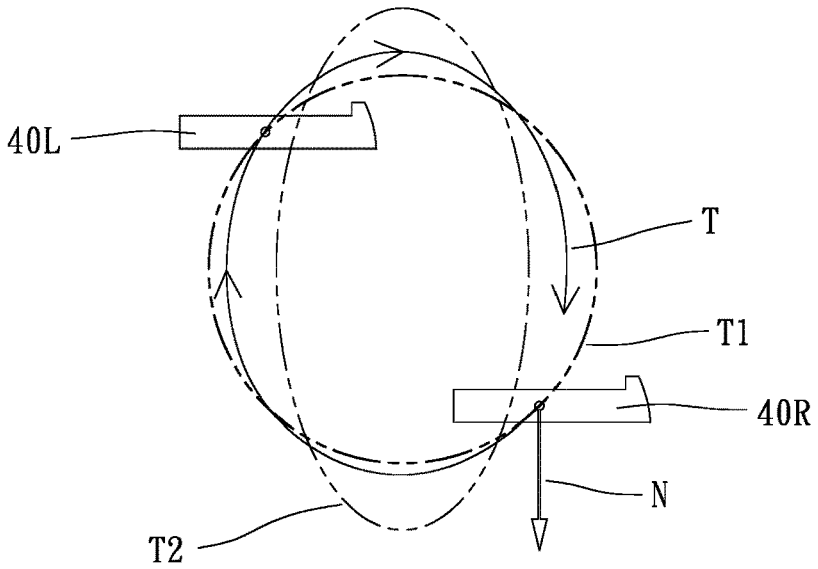

For example, as shown in FIG. 11A, during the displacement of the left pedal 40L and the right pedal 40R forwardly and downwardly from the top of the circular path, the direction of the net force N is obviously deviated to the front. It can be presumed that the user wants to expand the amount of the horizontal displacement of the leg exercise, so that the control unit 90 will automatically select the second exercise program, and the displacement paths of the pedals 40L, 40R are appropriately corrected in the next few turns (eg. two or three turns) such that the displacement paths of the pedals 45L, 40R are gradually approach the second displacement path T2 along a smooth transition path T and further changed to the second displacement path T2. Similarly, as shown in FIG. 11B, during the displacement of the left pedal 40L and the right pedal 40R forwardly and downwardly from the top of the circular path, the direction of the net force N is obviously deviated to the bottom. It can be presumed that the user wants to expand the amount of the vertical displacement of the leg exercise, so that the control unit 90 will automatically select the third exercise program, and the displacement paths of the pedals 40L, 40R are appropriately corrected so as to control the displacement paths of the left pedal 40L and the right pedal 40R gradually changed to the second displacement path T3.

Moreover, in the preferred embodiment (not shown), the power operated exercise apparatus may be provided with a movable handle set including a left handle, a right handle, a left handle drive mechanism configured to drive the left handle, a right handle drive mechanism configured to drive the right handle, a handle position measuring device configured to measure the position of at least one of the two handles, a left handle force measuring device configured to measure the force applied to the left handle, and a right handle force measuring device configured to measure the force applied to the right handle. The aforementioned control unit can also control actions of the two handle drive mechanisms and receive the measuring contents of the handle position measuring device and the two force measuring devices. In brief, the left and right handles can be controlled as the aforementioned left and right pedals. The aforementioned exercise programs also include a displacement path of the two handles and a correlation between the two handles on the displacement path, and further include a correlation between the two handles and the two pedals. During exercise, the control unit controls the displacement of the two handles according to the positions and the force conditions of the two handles. In addition, the force conditions of the two handles may be combined with the force conditions of the two pedals for determination like the correlation between hands and feet in general elliptical exercise machines.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus, comprising:

a frame;

a left pedal configured to support a left foot of a user;

a right pedal configured to support a right foot of the user;

a left drive mechanism connected between the frame and the left pedal, the left drive mechanism configured to drive the left pedal to move with respect to the frame and to control at least vertical position and horizontal position of the left pedal;

a right drive mechanism connected between the frame and the right pedal, the right drive mechanism configured to drive the right pedal to move with respect to the frame and to control at least vertical position and horizontal position of the right pedal;

a position measuring device configured to measure a position of at least one of the left and right pedals with respect to the frame;

a left force measuring device configured to measure magnitude of forces applied to a front half region and a rear half region of the left pedal;

a right force measuring device configured to measure magnitude of forces applied to a front half region and a rear half region of the right pedal;

an interface device configured for allowing the user to input information; and a control unit electrically connected to the left drive mechanism, the right drive mechanism, the position measuring device, the left force measuring device, the right force measuring device and the interface device; the control unit configured for controlling actions of the left drive mechanism and the right drive mechanism, receiving measurement content of the measuring devices, and receiving the information input by the user via the interface device; the control unit storing a plurality of exercise programs for being selected by the user, each of the exercise programs being provided with a displacement path of the left pedal and the right pedal and a correlation between the left pedal and the right pedal on the displacement path;

wherein, the control unit is operable to obtain a direction and magnitude of a net force as a force acting on a middle portion of the left pedal based on a measurement content of the left force measuring device, and to obtain a direction and magnitude of a net force as a force acting on a middle portion of the right pedal based on a measurement content of the right force measuring device;

wherein, the exercise apparatus is provided for allowing the user to perform leg exercises; during at least one specific operation period, the control unit is operable to determine in which directions the left pedal and the right pedal should be respectively moved according to information of a current position of at least one of the left pedal and the right pedal and current force conditions of the left pedal and the right pedal so as to meet the displacement path and the correlation of a selected one of the exercise programs and to immediately control the left drive mechanism and the right drive mechanism to respectively drive the left pedal and the right pedal to move in a determined direction.

2. The exercise apparatus as claimed in claim 1, wherein the left drive mechanism is operable to drive the left pedal to change its angle relative to the frame; the right mechanism is operable to drive the right pedal to change its angle relative to the frame; each of the exercise programs further includes angular variations of the left pedal and the right pedal on the corresponding displacement path; and the control unit is operable to control the left drive mechanism and the right drive mechanism to respectively drive the left pedal and the right pedal to present predetermined angles at predetermined positions according to the selected exercise program.

3. The exercise apparatus as claimed in claim 1, wherein at least one of the exercise programs sets the displacement path as a closed path with vertical displacement and horizontal displacement, and the left pedal and the right pedal are kept opposite to each other on the closed path; the closed path defines a positive circulation direction and a reverse circulation direction; and when the force applied to one of the left pedal and the right pedal corresponding to the positive circulation direction exceeds the force applied to the other pedal corresponding to the reverse circulation direction by more than a preset resistance value, the control unit controls the left drive mechanism and the right drive mechanism to respectively drive the left pedal and the right pedal to move in the positive circulation direction.

4. The exercise apparatus as claimed in claim 3, wherein when the more the force applied to one of the left pedal and the right pedal corresponding to the positive circulation direction exceeds the force applied to the other pedal corresponding to the reverse circulation direction by more than the preset resistance value, the faster the speed of displacement of the left pedal and the right pedal driven by the left drive mechanism and the right drive mechanism.

5. The exercise apparatus as claimed in claim 1, wherein at least one of the exercise programs sets the displacement path as a non-closed path with two opposite ends, when one of the left pedal and the right pedal is located at a first end of the non-closed path, the other pedal is located at a second end of the non-closed path, and the first end of the non-closed path is higher than the second end and defines a descending direction from the first end to the second end and a rising direction from the second end to the first end; when the force applied to the left pedal corresponding to the descending direction exceeds the force applied to the right pedal corresponding to the descending direction by more than a preset resistance value, the control unit controls the left drive mechanism to drive the left pedal to move in the descending direction and controls the right drive mechanism to drive the right pedal to move in the rising direction at the same time; in contrast, when the force applied to the right pedal corresponding to the descending direction exceeds the force applied to the left pedal corresponding to the descending direction by more than the preset resistance value, the control unit controls the right drive mechanism to drive the right pedal to move in the descending direction and controls the left drive mechanism to drive the left pedal to move in the rising direction at the same time.

6. The exercise apparatus as claimed in claim 5, wherein when the more the force applied to one of the left pedal and the right pedal corresponding to the descending direction exceeds the force applied to the other pedal corresponding to the descending direction by more than the preset resistance value, the faster the speed of displacement of the left pedal and the right pedal driven by the left drive mechanism and the right drive mechanism.

7. The exercise apparatus as claimed in claim 3, wherein the interface device has a setting interface for allowing the user to set the resistance value.

8. The exercise apparatus as claimed in claim 4, wherein the interface device has a setting interface for allowing the user to set the resistance value.

9. The exercise apparatus as claimed in claim 5, wherein the interface device has a setting interface for allowing the user to set the resistance value.

10. The exercise apparatus as claimed in claim 6, wherein the interface device has a setting interface for allowing the user to set the resistance value.

11. The exercise apparatus as claimed in claim 1, further comprising a displacement measuring device for measuring a displacement velocity or acceleration of at least one of the left pedal and the right pedal; wherein, the control unit is electrically connected to the displacement measuring device to receive measurement content of the displacement measuring device, and the information on which the control unit is based for the determination also includes the present displacement velocity or acceleration of at least one of the left pedal and the right pedal.

* * * * *